United States Patent [19]

Richards

[11] 3,969,778

[45] July 20, 1976

[54] TOILET AIDS

[75] Inventor: Derek John Richards, Longhope, England

[73] Assignee: Mecanaids Limited, Great Britain

[22] Filed: May 8, 1975

[21] Appl. No.: 575,695

[30] Foreign Application Priority Data

May 18, 1974 United Kingdom ..... 22286/74

[52] U.S. Cl. ..... 4/254; 4/185 H; 4/185 S

[51] Int. Cl.[2] ..... E03D 11/00

[58] Field of Search ..... 4/254, 185 R, 185 H, 4/185 S, 134, 234

[56] References Cited

UNITED STATES PATENTS

| | | | |
|---|---|---|---|
| 1,210,419 | 1/1917 | Carney | 4/254 |
| 2,582,321 | 1/1952 | Farrell | 4/234 |
| 2,774,975 | 12/1956 | Frank | 4/254 |
| 3,209,376 | 10/1965 | Drury, Jr. | 4/254 |
| 3,323,144 | 6/1967 | Farris, Jr. | 4/254 |

FOREIGN PATENTS OR APPLICATIONS

| | | | |
|---|---|---|---|
| 1,208,432 | 2/1960 | France | 4/254 |

*Primary Examiner*—Henry K. Artis
*Attorney, Agent, or Firm*—Cushman, Darby & Cushman

[57] ABSTRACT

A toilet aid is designed for use with a W.C. to assist disabled, elderly and infirm persons using the W.C. The aid is constructed for attachment to the W.C. pan using the normal seat-attachment bolt holes provided in the pan. An arm structure has side support arms which extend fowardly on either side of a user when seated on the toilet seat. The arms have inturned end portions to provide front support for the user, these portions being movable to the side to a front entry position which permits free entry and exit between the arms. When the arm portions are in this entry position the main side portions of the arms remain in their normal side support position, thus being positioned to assist the user when maneuvering into and out of the seated position. The aid can be used with all normal W.C. suites with a standard toilet seat.

11 Claims, 3 Drawing Figures

TOILET AIDS

BACKGROUND OF THE INVENTION

This invention relates to toilet aids designed to assist disabled, elderly and infirm persons to use a W.C., and of the type which is fixed relatively to the W.C. pan and provides side support arms and handgrips for a user.

Such an aid helps a user to get on and off the toilet seat, thereby in many cases enabling him to do so unaided, and provides side support when seated. However, there is always the danger of a user with disturbed balance falling forwards off the toilet seat, and the attendance of nursing staff is often necessary merely to ensure this does not happen.

SUMMARY OF THE INVENTION

An object of the invention is to provide a toilet aid which renders the presence of an attendant unnecessary, thereby releasing nursing staff for other duties and restoring patient dignity, and which also can support a patient during so-called "manual evacuation".

To this end, according to the invention, a toilet aid is constructed for attachment to a W.C. pan, using the normal seat-attachment bolt holes provided in the pan, and has side support arms which extend forwardly either side of a user when seated and which have inturned end portions to provide front support for the user, at least the end portions of the arms being movable to the side to a "front entry" position which permits free entry and exit between the arms with main side portions of the arms positioned to assist the user when manoeuvring into and out of the seated position.

The end arm portions may be movable to said entry position relatively to the main side arm portions with the latter remaining stationary in the normal side support positions, although alternatively the side arms may move sideways as a whole through a limited range to an entry position which provides adequate clearance between the inturned end portions. In the latter case the arms should be securely retained, by locking means, in the normal side and front support position.

The end portions may turn about the longitudinal axes of the respective main side arm portions, preferably through substantially 180° from an inturned generally horizontal position providing the required forward support to an out-turned generally horizontal position. In the latter position, in one embodiment, the end portions are slightly downwardly inclined although in some cases a slight upward inclination may be preferable. Moulded handgrips may be fitted on the ends of the arms to facilitate use when in the out-turned position as supports for a user taking up or leaving the seated position.

The aid preferably provides, or allows for, pivotal mounting of the toilet seat whereby the latter can be raised to a urinal position, or for cleaning purposes, independently of the side arm structure which can thus remain in its normal operative position to provide support for the user while standing. The pivotal mounting for the seat may be provided, or fixed in position, by the fixing bolts which attach the aid to the W.C. pan.

Preferably the aid includes a pivotal mounting for the arm structure so that the latter structure can pivot rearwardly out of the way when not required, or to facilitate cleaning. The arrangement may be such that although the seat can be raised independently of the arm structure the latter when pivoted rearwardly takes the seat with it leaving the pan clear for cleaning access. The pivotal mounting for the toilet seat preferably enables a standard toilet seat to be fitted, thus providing the advantage that the aid can be fitted using an existing toilet seat and avoiding the expense of a special-purpose replacement seat.

The toilet aid may have a backrest, conveniently a moulded plastics backrest, particularly when for use with a high-level cistern W.C. This backrest may be an optional fitting in the sense that it can be removed or omitted during assembly, so that when the aid is used with a low-level suite the cistern thereof as usual provides the backrest or a back support for a toilet lid which provides the backrest. Alternatively, the support structure may include upstanding back abutment means for use when the aid is to be used with a toilet lid as well as the seat, so that when the lid is lifted it rests back against the abutment means to provide a suitable backrest.

The invention enables a toilet aid to be manufactured which not only provides front support and utilises a standard toilet seat which can be independently raised, but which also does not involve the provision of any form of floor support. To this end the arm structure may have forwardly projecting reaction legs or struts which engage the top rim of the W.C. pan, forwardly of the pivot axis of the arm structure, below the seat. These legs thus engage below the seat to lift the latter as the arm structure is pivoted upwardly and rearwardly, and perform the additional function of spreading the loading on the pan while leaving the floor completely unobstructed.

DESCRIPTION OF THE PREFERRED EMBODIMENT

Figure 1:
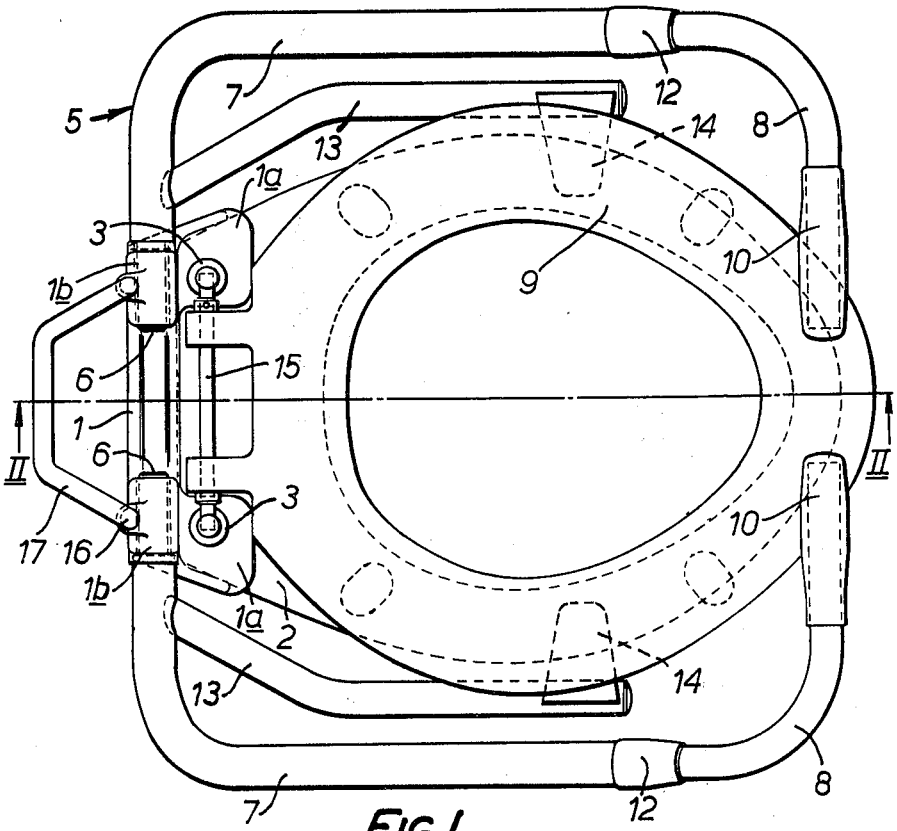
FIG. 1 is a plan view showing an aid embodying the invention attached to a W.C. pan and in the normal operative position.

A support structure comprises a moulded support bracket member 1 which extends laterally across the rear of a typical W.C. pedestal 2, only the rim section of which is shown. This member 1 has end mounting flanges **1*a* which seat on the pedestal 2 and are fixed by mounting bolts 3 which also pass through the normal seat fixing bolt holes 4 in the pedestal, thus clamping the bracket member directly to the pedestal. The casting 1 also includes two spaced aligned bearing bosses 1*b* in which an arm structure 5 comprising a pair of side arm assemblies for side support of a user is pivotally supported, each of which includes a shaft 6 which is supported and turns in the corresponding boss 1*b***.

Figure 2:
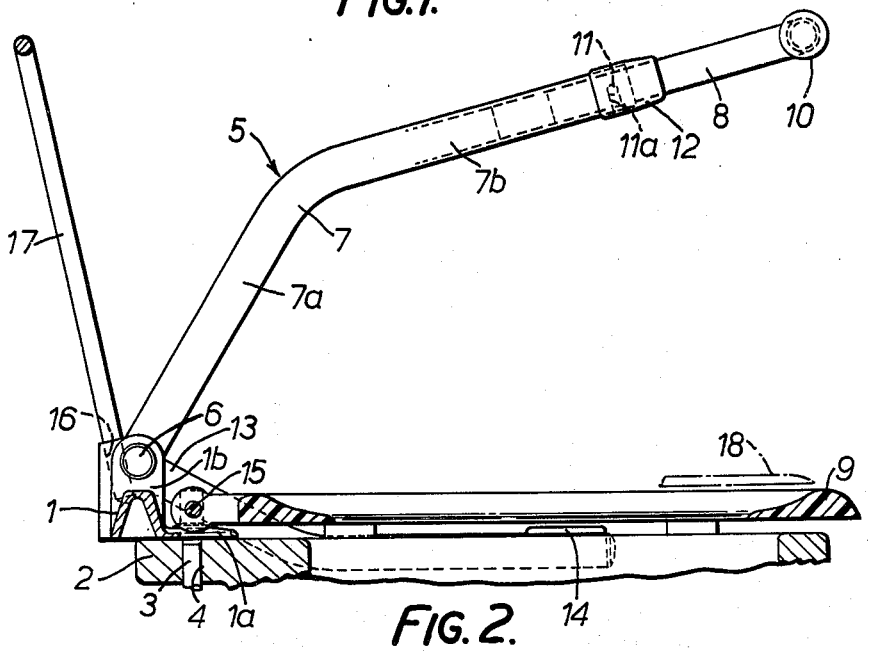
FIG. 2 is a sectional view on the line II— II in FIG. 1.

Each arm assembly comprises a main side arm portion 7 which is inturned at its inner (or rear) end where it fits over the corresponding shaft 6. The arm portion 7 is cranked, providing a rear section **7*a* which extends upwardly from the mounting structure at an inclination of about 45° to the horizontal and a front section which extends mainly forwardly and is inclined upwardly at an angle of about 30° to the horizontal. Each side arm has an end portion 8 which is bent round through a right angle, to provide an inner end which fits and turns within the front end of the forward section 7*b* of the corresponding main arm portion 7, and a free end which in the operative position shown in FIGS. 1 and 2 provides front support for a user seated on the toilet seat 9** and extends generally horizontally inwards at a slight upward inclination.

Figure 3:
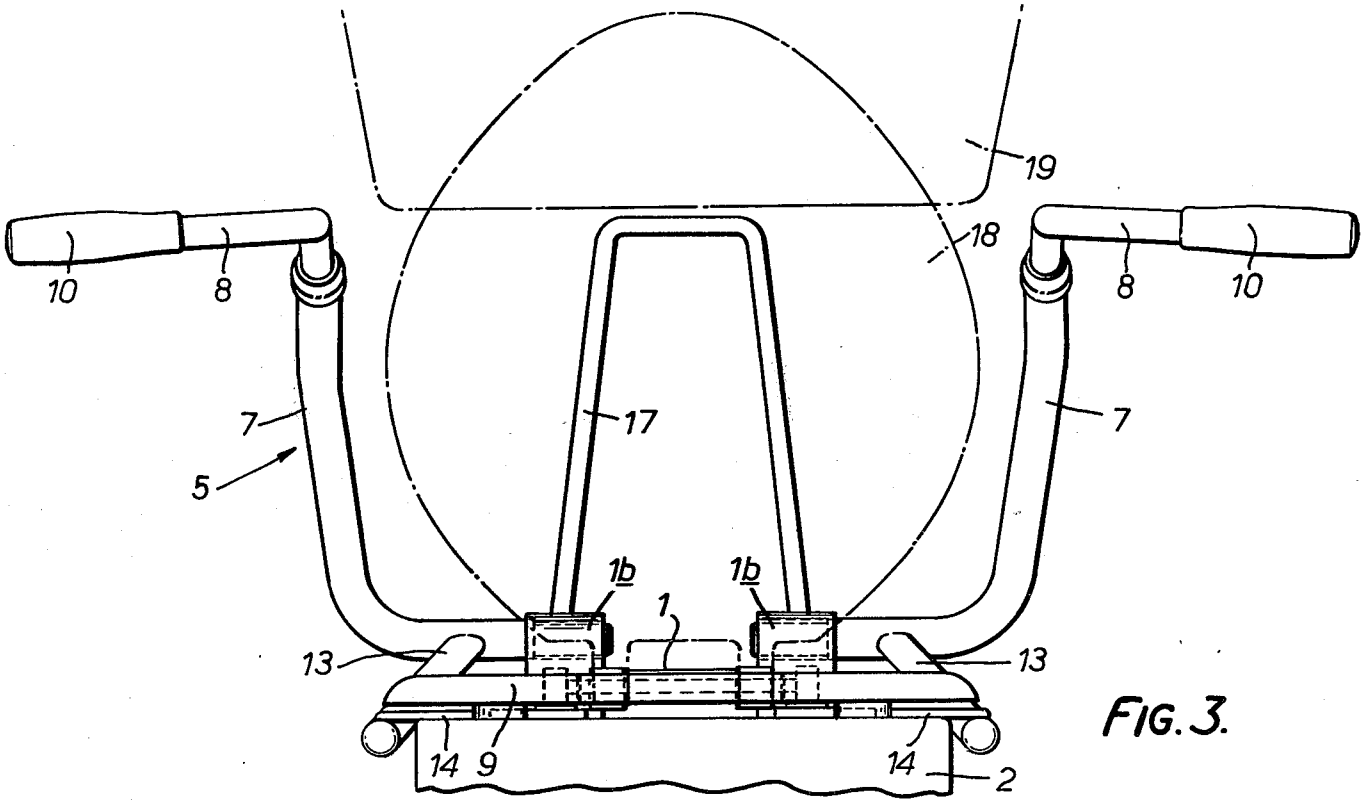
FIG. 3 is a front view showing this aid in the front entry condition.

In the inturned front support position there is a small gap of about three inches between the end arm portions 8 which, at their free ends, are fitted with moulded handgrips 10. Thus the user is effectively encircled and cannot fall off the toilet seat 9. A crosspin 11 fitted in each arm end portion 8 (FIG. 2) retains the latter captive in the end of the corresponding main arm portion 7, and its pin engages a peripheral slot 11*a* in the portion 7 to allow limited 180° angular movement of the end portion 8. Thus the end portions 8 can be turned outwardly to a front entry position, as shown in FIG. 3, in which they project generally horizontally allowing free entry and exit from between the main arm portions 7. In the out-turned positions of the arm portions 8 illustrated in FIG. 3 the handgrips 10 provide considerable assistance for the user as he manoeuvres himself on to and off the seat, and also from and back into a wheelchair. The pin and slot are concealed by a moulded sleeve 12, the sleeve 12 providing alternative handgrips for the user.

Each side arm assembly has a reaction leg 13 which projects forwardly and downwardly and is attached to the arm portion 7 adjacent the rear end thereof. The reaction legs 13 have, at their forward ends, inwardly directed abutment lugs 14 which engage the top edge of the upper rim of the W.C. pedestal 2 well forwardly of the support structure 1. The legs 13 thus spread the load on the pedestal when the weight of the user is applied to the arms, which are cantilevered forwardly from the legs 13, and the lugs 14 also engage beneath the seat 9 so that the latter pivots rearwardly to the urinal position with the arm structure 5 as the latter is tilted back in the bearing bosses 1*b*.

The standard toilet seat 9 is pivotable on a spindle 15 supported at the ends in the heads of the fixing bolts 3 which thus provide an independent pivotal mounting for the seat 9. The ability to use a standard seat, independently pivotable to the urinal position with the aid remaining in a user support position, coupled with support of the aid by the pedestal itself, is a particular advantage provided by the invention.

The bearing bosses 1*c* have rearwardly projecting ears with upwardly and rearwardly inclined mounting bores 16. Abutment means, to provide a back support for a normal toilet lid 18 pivotally mounted on the spindle 15, are an optional fitment in the mounting bores 16. Such abutment means, as shown in the drawings, comprise a generally U-shaped frame with mutually divergent side limbs the free lower ends of which fit into the bores 16 and which respectively engage peripheral grooves in the shafts 6 for axial location thereof. The frame 17 when fitted is backwardly inclined and enables the lid 18, omitted from FIG. 1 and shown in broken lines in FIGS. 2 and 3, to be used as a backrest with a high-level W.C. suite. As an alternative, also for use with a high-level suite, a moulded backrest may be provided for the illustrated aid although such a backrest is not shown in the drawings.

With a low-level W.C. suite as illustrated in FIG. 3 neither the abutment frame 17 nor the moulded backrest will normally be required. The W.C. cistern 19 (indicated in broken lines in FIG. 3) either supporting te lid 18 when the latter is turned back or, in the absence of a lid, itself providing a back support.

It will be appreciated that the described construction provides several particularly marked advantages and novel combinations thereof. One of these is that it can be fitted to a W.C. pan using the normal fixing holes therein, and as compared with the more usual floor-mounted constructions does not impede floor cleaning, while the toilet seat can be lifted independently to a urinal position leaving the arm structure available to support a standing patient. Another advantage is that a completely standard toilet seat and lid can be used, and hence the aid fitted retaining the existing seat and lid. A particularly important advantage is that in use reliable front support is provided, enabling seated patients who would otherwise require the constant presence of an attendant to be left unattended.

With some disabled users a seat height higher than normal is required, and with the aid of the invention this requirement is readily met. A spacer ring, on which the seat rests and thus which effectively increases the height of the toilet pan can be clamped between the aid and the rim of the existing pan, with the fixing bolts of the aid passing through this ring and fixing it in position.

I claim:

1. A toilet aid constructed for attachment to a W.C. pan, using the normal seat-attachment bolt holes provided in the pan, with support arms which extend forwardly on each side of a user when seated and which have inturned end portions connected thereto to provide front support for the user, at least the end portions of the arms being movable to the side to a front entry position which permits free entry and exit between the arms with main side portions of the arms positioned to assist the user when manoeuvring into and out of the seated position.

2. A toilet aid according to claim 1, wherein the end arm portions are movable to the entry position relatively to the main side arm portions which during such movement remain stationary in the normal side support positions.

3. A toilet aid according to claim 2, wherein the end arm portions turn about the longitudinal axes of the respective main side arm portions.

4. A toilet aid according to claim 1, wherein the aid provides, or allows for, pivotal mounting of the toilet seat whereby the latter can be raised to a urinal position independently of the side arm structure which thus remains in its normal operative position to support the user while standing.

5. A toilet aid according to claim 1, including a pivotal mounting for the arm structure as a whole so that the latter structure can pivot rearwardly out of the way when not required, or to facilitate cleaning.

6. A toilet aid according to claim 1, wherein means are provided for the detachable fixing of an optional backrest or back support for a toilet lid.

7. A toilet aid according to claim 1, wherein a backrest or a back support for a toilet lid, is fitted.

8. A toilet aid according to claim 1, wherein forwardly projecting reaction support legs or struts are positioned to engage the top rim of the W.C. pan.

9. A toilet aid according to claim 8, wherein the legs or struts are positioned to engage the rim forwardly of the pivot axis of the arm structure and below the toilet seat.

10. A toilet aid according to claim 4, in combination with fixing bolts which provide or attach a pivotal mounting for the toilet seat.

11. A toilet aid according to claim 1, wherein the aid is adapted to be attached to the W.C. pan with a support structure of the aid clamped directly to the pan by fixing bolts passing through said normal seat-attachment bolt holes.

* * * * *